US008206462B2

(12) United States Patent
Barreleiro et al.

(10) Patent No.: US 8,206,462 B2
(45) Date of Patent: Jun. 26, 2012

(54) USE OF POLYMERS COMPRISING CARBOXYL GROUPS IN COMBINATION WITH BIVALENT CATIONS FOR CREATING A PROTECTIVE LAYER

(75) Inventors: Paula Barreleiro, Düsseldorf (DE); Danuta Bedrunka, Dormagen (DE); Wolfgang von Rybinski, Düsseldorf (DE); Arndt Scheidgen, Essen (DE)

(73) Assignee: Henkel AG & Co. KGaA, Dusseldorf (DE)

( * ) Notice: Subject to any disclaimer, the term of this patent is extended or adjusted under 35 U.S.C. 154(b) by 0 days.

(21) Appl. No.: 13/235,626

(22) Filed: Sep. 19, 2011

(65) Prior Publication Data

US 2012/0025125 A1 Feb. 2, 2012

Related U.S. Application Data

(63) Continuation of application No. PCT/EP2010/052967, filed on Mar. 9, 2010.

(30) Foreign Application Priority Data

Mar. 20, 2009 (DE) ..... 10 2009 001 693
Mar. 24, 2009 (DE) ..... 10 2009 001 803

(51) Int. Cl.
*D06M 11/00* (2006.01)

(52) U.S. Cl. ..... 8/133; 8/137; 8/137.5

(58) Field of Classification Search ..... 8/133, 137, 8/137.5

See application file for complete search history.

(56) References Cited

U.S. PATENT DOCUMENTS

| | | | | |
|---|---|---|---|---|
| 3,993,830 | A * | 11/1976 | Dickson et al. | 442/93 |
| 4,007,305 | A | 2/1977 | Kakar et al. | |
| 2004/0250354 | A1 | 12/2004 | Hamers et al. | |
| 2006/0019860 | A1 | 1/2006 | Cardozo et al. | |

FOREIGN PATENT DOCUMENTS

| | | | |
|---|---|---|---|
| DE | 10331053 | A1 | 1/2005 |
| EP | 0979861 | B1 | 12/2004 |
| WO | WO 96/04940 | A1 | 2/1996 |
| WO | WO 00/24856 | A1 | 5/2000 |
| WO | WO 03/040279 | A1 | 5/2003 |
| WO | WO 2004/048677 | A1 | 6/2004 |
| WO | WO 2007/118732 | A1 | 10/2007 |
| WO | WO 2008/107346 | A2 | 9/2008 |
| WO | WO 2009/071451 | A2 | 6/2009 |

OTHER PUBLICATIONS

PCT International Search Report (PCT/EP2010/052967) dated May 19, 2010.

* cited by examiner

*Primary Examiner* — Eisa Elhilo
(74) *Attorney, Agent, or Firm* — Thomas G. Krivulka

(57) ABSTRACT

The present invention relates to the use of polymers comprising carboxyl groups in combination with bivalent cations for producing a protective layer on a textile sheet material and to textile treatment agents, in particular washing and cleaning agents containing said polymers in a suitable form of administration, in order to enable the formation of a protective layer on textile sheet materials.

8 Claims, No Drawings

USE OF POLYMERS COMPRISING CARBOXYL GROUPS IN COMBINATION WITH BIVALENT CATIONS FOR CREATING A PROTECTIVE LAYER

CROSS-REFERENCES TO RELATED APPLICATIONS

This application is a continuation of PCT/EP2010/052967, filed on Mar. 9, 2010, which claims priority under 35 U.S.C. §119 to DE 10 2009 001 693.7 filed on Mar. 20, 2009, and DE 10 2009 001 803.4 filed on Mar. 24, 2009.

FIELD OF THE INVENTION

The present invention generally relates to the use of polymers with carboxyl groups in combination with divalent cations for forming a protective layer on textile fabrics as well as textile treatment agents, in particular washing and cleaning agents that comprise such polymers in a suitable dosage form, in order to enable the formation of a protective layer on textile fabrics.

BACKGROUND OF THE INVENTION

In addition to the wish to remove stains from textiles in the most effective possible manner, there exists a further approach for the provision of clean laundry consisting in preventatively impeding a soil deposition on the textiles. Polymers that possess soil repellent properties, the so-called "soil release" or "soil repellency" polymers, have already been described for this purpose.

With this in mind, U.S. Pat. No. 4,007,305 in particular discloses the finishing of textiles with an alkaline aqueous solution that contains fluorinated chemicals, water-soluble polyvinyl pyrrolidone and polymers with carboxyl groups.

The use of substituted polysaccharides for equipping textiles is disclosed in WO 03/040279.

BRIEF SUMMARY OF THE INVENTION

According to the present invention, it has now been surprisingly found that an effective protective layer can be formed on textile fabrics by employing polymers with carboxyl groups in combination with divalent cations.

Accordingly, the present invention relates to textile treatment agents, in particular washing and cleaning agents that comprise polymers with carboxyl groups and divalent cations. In this regard an inventive textile treatment agent preferably comprises a) polymers with carboxyl groups in a concentration of 1 to 10 wt. %, particularly preferably 2 to 4 wt. %, b) divalent cations in a concentration of 0.001 to 1.0 wt. %, particularly preferably 0.005 to 0.5 wt. %, above all 0.01 to 0.1 wt. %.

Accordingly, the present invention further relates to the use of polymers with carboxyl groups in combination with divalent cations or the use of an inventive textile treatment agent for finishing textile fabrics.

Furthermore, the present invention relates to the use of polymers with carboxyl groups in combination with divalent cations or the use of an inventive textile treatment agent for forming a protective layer on textile fabrics. In this regard the protective layer is preferably suitable for at least partially keeping soils away from textile fabrics in that the soils are preferably deposited on the protective layer rather than on the fabrics.

The present invention also relates to a process for finishing textile fabrics, wherein the textile fabrics are treated with a combination of polymers with carboxyl groups and of divalent cations or with an inventive textile treatment agent, wherein this treatment can both be carried out in one step as well as in sequential process steps. Thus the treatment with the polymers can occur first and then the treatment with the divalent cations or conversely, first the treatment with the divalent cations and then the treatment with the polymers. However, in a preferred embodiment the treatment occurs simultaneously with the polymers and with the divalent cations.

Furthermore, other desirable features and characteristics of the present invention will become apparent from the subsequent detailed description of the invention and the appended claims.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In particular, the polymer with carboxyl groups of the present invention can be obtained by polymerizing monomers that carry ethylenically unsaturated carboxyl groups. Thus it can be a polymer that is obtained by polymerizing or copolymerizing acrylic acid, methacrylic acid or alkyleneterephthalic acids, in particular ethyleneterephthalic acid. With this in mind, polyacrylic acid or polymethacrylic acid are especially inventively employable.

However, in a preferred embodiment the polymer with carboxyl groups is a polysaccharide that contains sugar units that carry carboxyl groups. In this regard the sugar units that carry carboxyl groups are preferably uronic acids, in particular hexuronic acids, principally glucuronic acid, galacturonic acid, iduronic acid or mannuronic acid. Besides uronic acids however, sugar units that are modified for example by carboxyl groups or carboxymethyl groups also come into consideration, such as for example carboxymethyl glucose.

In a preferred embodiment, at least 20%, in particular at least 30, 40 or 50%, particularly preferably at least 60, 70 or 80%, above all at least 90 or 95% of the monomer units of the polymer possess at least one carboxyl group, preferably one, two or three carboxyl groups.

In a preferred embodiment, the polymer is correspondingly a polysaccharide, in which at least 20%, in particular at least 30, 40 or 50%, particularly preferably at least 60, 70 or 80%, above all at least 90 or 95% of the monomer units of the polysaccharide represent uronic acids, in particular hexuronic acid, wherein the uronic acids are preferably selected from glucuronic acid, galacturonic acid, guluronic acid, iduronic acid and mannuronic acid.

In addition, the molecular weight of the polymer with carboxyl groups is preferably from 1000 to 500 000 g/mol, particularly preferably from 10 000 to 200 000 g/mol.

The carboxyl groups of the polymers according to the invention can also be partially esterified with alcohols, in particular with $C_{1-6}$ alkanols.

In a particularly preferred embodiment, the polymer with carboxyl groups is selected from the polysaccharides alginate, pectin, glucosaminoglucans, in particular hyaluronic acid or heparin, astragalus, gum arabicum, teichuronic acids and carboxymethyl cellulose, wherein alginate and pectin are particularly preferred.

In a preferred embodiment, the inventively employed polymer is used in the form of a water-soluble salt, in particular as the sodium, potassium or ammonium salt.

The polymer with carboxyl groups is preferably inventively employed in an amount of 1 to 10 wt. %, particularly preferably 2 to 4 wt. %.

The divalent cations are inventively preferably selected from Ca(II), Mg(II), Fe(II) and Zn(II). Ca(II) is particularly preferably employed.

The divalent cations can be employed in any soluble salt form, in particular in the form of an inorganic or organic salt. Halides, in particular fluorides, chlorides or bromides, nitrates or sulfates are preferably employed.

The divalent cations are inventively preferably employed in an amount of 0.001 to 1.0 wt. %, particularly in an amount of 0.005 to 0.5 wt. %, particularly preferably in an amount of 0.01 to 0.1 wt. %.

The textile finishing or the washing process is preferably done at a temperature of 20 to 60° C., particularly preferably at a temperature of 20 to 40° C.

The textile finishing or the washing process is preferably done at a pH of 6 to 11, particularly preferably at a pH of 7.5 to 9.5.

The textile treatment agent according to the invention can exist in any dosage form. For example, it can be in the form of a powder, a liquid or a gel. In a preferred embodiment it is in the form of a liquid or has the consistency of a gel. The polymers with carboxyl groups as well as the divalent cations are preferably present in the liquid or gel-like textile treatment agent in soluble form.

In a particularly preferred embodiment the inventive textile treatment agent is a washing or cleaning agent.

Washing and Cleaning Agents

An inventive washing or cleaning agent and in particular an inventive textile washing agent can comprise additional active washing or cleaning ingredients, for example surfactants especially anionic, non-ionic, cationic and/or amphoteric surfactants, builders, especially inorganic and organic builders, active cleaning polymers (for example those with cobuilder properties), foam inhibitors, colorants, fragrances (perfumes), bleaching agents (such as for example peroxy bleaching agents and chlorine bleaching agents), bleach activators, bleach stabilizers, bleach catalysts, enzymes, enzyme stabilizers, anti-graying inhibitors, optical brighteners, UV absorbers, soil repellents or soil release polymers, binding and disintegration auxiliaries, electrolytes, non-aqueous solvents, pH adjustors, perfume carriers, fluorescent agents, thickeners, hydrotropes, silicone oils, shrink preventers, anti-crease agents, color transfer inhibitors, antimicrobials, germicides, fungicides, antioxidants, preservatives, corrosion inhibitors, antistats, bittering agents, ironing auxiliaries, waterproofing and impregnation agents, swelling and anti-slip agents, textile softening components, especially ester-quats, heavy metal complexing agents, abrasives, fillers and/or blowing agents.

In regard to inventively preferred employable builders, surfactants, fabric softening components, especially ester-quats, polymers, bleaching agent, bleach activators, bleach catalysts, solvents, thickeners, optical brighteners, anti-graying agents, anti-crease agents, antistats, glass corrosion inhibitors, corrosion inhibitors, "soil repellents", color transfer inhibitors, foam inhibitors, abrasives, disintegration auxiliaries, acidifiers, colorants, fragrances, antimicrobials, UV absorbers and blowing agents as well as their preferred added amounts, reference is made to the laid open publications WO2008/107346 and WO2009/071451.

Processes for cleaning textiles, in which a combination of polymers with carboxyl groups and of divalent cations are employed in at least one of the process steps, represent a separate subject matter of the invention.

These processes include both manual as well as automatic processes, automatic processes being preferred due to their more precise controllability that concerns for example the added quantities and contact times.

Processes for the cleaning of fabrics are generally characterized in that various cleaning-active substances are applied to the material to be cleaned in a plurality of process steps and, after the contact time, are washed away, or that the material to be cleaned is treated in any other way with a washing agent or a solution of this agent. It is possible to add a combination of polymers with carboxyl groups and of divalent cations in at least one of the process steps of all conceivable washing or cleaning processes; these processes then illustrate embodiments of the present invention.

The use of a combination of polymers with carboxyl groups and of divalent cations for cleaning textiles represents a separate subject matter of the invention. Washing by hand or the manual removal of blemishes from textiles or from hard surfaces or the use in connection with an automatic process are exemplary embodiments.

Another subject matter of the present invention is also a product comprising an inventive composition or an inventive textile treatment agent, in particular washing or cleaning agents, and a spray dispenser. In this regard, the product can be either a single chamber container as well as a multi-chamber container, in particular a two-chamber container. The preferred spray dispenser is a manually operated spray dispenser, selected in particular from the group including aerosol spray dispensers pressurized gas containers; also known inter alia as spray cans), self-generated pressure spray dispensers, pump spray dispensers and trigger spray dispensers, particularly pump spray dispensers and trigger spray dispensers with a container made of transparent polyethylene or polyethylene terephthalate. Spray dispensers are extensively described in WO 96/04940 (Proctor & Gamble) and in the US patents cited therein concerning spray dispensers, all of which are referred to in this respect and their content is hereby incorporated in this application. Trigger spray dispensers and pump spray dispensers are advantageous in comparison with pressurized gas containers as no propellant need be employed. By means of attachments suitable for particles, ("nozzle-valves") on the spray dispenser, the optionally comprised enzyme in this embodiment can also be optionally added in the form of immobilized particles to the composition and can thus be dosed as the cleaning foam.

Particularly preferred textile treatment agents contain

- 1 to 20 wt. %, preferably 3 to 15 wt % and especially 5 to 12 wt. % of non-ionic, surfactants, in particular fatty alcohol ethoxylates;
- 1 to 20 wt. %, preferably 3 to 15 wt. % and especially 5 to 12 wt. % of anionic surfactants, in particular from the group of the sulfates or sulfonates, especially linear alkylbenzene sulfonates;
- 0.5 to 10 wt. %, preferably 1 to 8 wt. % and especially 2 to 6 wt. % of fatty acids;
- 0.1 to 8 wt. %, preferably 0.5 to 6 wt. % and especially 1 to 5 wt. % of organic acids, in particular polycarboxylic acids and especially citric acid;
- 0.1 to 5 wt. %, preferably 0.2 to 4 wt. % and especially 0.5 to 3 wt. % of enzyme(s), preferably selected from amylases and proteases;

0.1 to 10 wt. %, preferably 1 to 10 wt. % and especially 2 to 4 wt. % of polymers with carboxyl groups, especially polysaccharides with carboxyl groups, especially alginate or pectin; as well as 0.001 to 1.0 wt. %, preferably 0.005 to 0.5 wt. % and especially 0.01 to 0.1 wt. % of divalent cations, especially Ca(II), preferably in the form of an organic or inorganic salt.

EXAMPLES

Example 1

Washing Tests with Alginate and Calcium Ions

A washing agent composition comprising:

| | |
|---|---|
| Fatty alcohol polyethylene oxide | 7.0% |
| LAS | 9.0% |
| Coconut fatty acid | 4.0% |
| Boric acid | 1.0% |
| Citric acid | 2.0% |
| Propylene glycol | 6.0% |
| PTPMP | 0.2% |
| NaOH | 3.1% |
| Protease | 0.8% |
| Amylase | 0.1% |
| Water | remainder |

was mixed on the one hand with 2 wt. % of alginate (Texamid 558 P from Cognis), on the other hand with 2 wt. % of alginate and 0.15 wt. % of $CaCl_2$. Textiles made of pure cotton were then washed with these washing agent compositions as well as with a washing agent composition as a comparison without added alginate and $CaCl_2$.

A washing machine Miele W 918 Novotronic was used for the washing tests. 3.5 kg of clean washing was washed with the standard program with a simple wash cycle at 40° C. using water with a German hardness of 16°. The liquid volume was 18 liters. In order to obtain a statistical mean, 5 parallel wash tests were each carried out.

The clean textiles were each washed three times under the abovementioned conditions each with 100 g of the previously cited washing agent composition. After the third cycle the textiles were soiled with engine oil. The intensity of the soils was recorded with a Minolta camera CR 200 and then left at room temperature for 7 days. The aged soils were then washed again under the previously cited conditions, then allowed to dry and the intensity values of the soils were again determined with the Minolta camera CR 200.

The differences in the intensity values are listed below and were obtained from the difference of each of the obtained intensity values before and after the soiled textiles were washed. The greater the difference the more pronounced is the achieved lightening.

| Soil | Reference | Alginate | Alginate + 0.15% $CaCl_2$ |
|---|---|---|---|
| Engine oil | 30.8 | 38.0 | 42.0 |

The results show that an increase in the fat dissolution power could already be achieved in regard to engine oil by adding the alginate to the washing agent composition; however a further significant increase in the fat dissolution power could be achieved by adding $CaCl_2$.

Example 2

Washing Tests with Pectin and Calcium Ions

A washing agent composition comprising:

| | |
|---|---|
| Fatty alcohol polyethylene oxide | 7.0% |
| LAS | 9.0% |
| Coconut fatty acid | 4.0% |
| Boric acid | 1.0% |
| Citric acid | 2.0% |
| Propylene glycol | 6.0% |
| PTPMP | 0.2% |
| NaOH | 3.1% |
| Protease | 0.8% |
| Amylase | 0.1% |
| Water | remainder |

was mixed on the one hand with 2 wt. % of pectin (PEKTIN AMID AF 025 from Herbstreith & Fox), on the other hand with 2 wt. % pectin as well as 0.15 wt. % of $CaCl_2$. Textiles made of pure cotton were then washed with these washing agent compositions as well as with a washing agent composition as a comparison without added pectin and $CaCl_2$.

A washing machine Miele W 918 Novotronic was used for the washing tests. 3.5 kg of clean washing was washed with the standard program with a simple wash cycle at 40° C. using water with a German hardness of 16°. The liquid volume was 18 liters. In order to obtain a statistical mean, 5 parallel wash tests were each carried out.

The clean textiles were each washed three times under the abovementioned conditions each with 100 g of the previously cited washing agent composition. After the third cycle the textiles were soiled with engine oil. The intensity of the soils was recorded with a Minolta camera CR 200 and then left at room temperature for 7 days. The aged soils were then washed again under the previously cited conditions, then allowed to dry and the intensity values of the soils were again determined with the Minolta camera CR 200.

The differences in the intensity values are listed below and were obtained from the difference of each of the obtained intensity values before and after the soiled textiles were washed. The greater the difference the more pronounced is the achieved lightening.

| Soil | Reference | Alginate | Alginate + 0.15% $CaCl_2$ |
|---|---|---|---|
| Engine oil | 30.8 | 40.7 | 45.7 |

The results show that an increase in the fat dissolution power could already be achieved in regard to engine oil by adding the alginate to the washing agent composition; however a further significant increase in the fat dissolution power could be achieved by adding $CaCl_2$.

Example 3

Formulations

| | E1 | E2 | E3 |
|---|---|---|---|
| C12-18 Fatty acid | 7.5 | 6 | 3 |
| C12-18 Fatty acid with 7 EO | 12 | 12 | 10 |
| Sodium lauryl ether sulfate with 2 EO | 5 | 2 | 5 |
| C12-C14-APG | — | — | 2.5 |
| Linear C10-13 alkylbenzene sulfonic acid | 9.6 | 16 | — |
| Citric acid | 3 | 3.5 | 1 |
| Phosphonic acid | 1 | 0.8 | 0.2 |
| Boric acid | 1 | 1 | 1 |
| Polyacrylate thickener | 0.35 | 0.75 | 0.1 |
| NaOH (50% conc.) | 4.70 | 5.4 | 1.48 |
| Optical brightener | 0.08 | 0.1 | 0.04 |
| 1,2-Propane diol | 7 | 8.5 | — |
| Glycerin | — | — | 4.5 |
| Silicone defoamer | 0.1 | 0.1 | 0.01 |
| Enzymes (cellulase, protease & amylase) | 1.4 | 1.4 | 0.6 |
| Perfume | 1.5 | 1.5 | 0.75 |
| Alginate | 2.5 | — | 1 |
| Pectin | — | 3 | 2.5 |
| $CaCl_2$ | 0.05 | 0.1 | 0.1 |
| Colorant | + | + | + |
| Water | ad 100 | ad 100 | ad 100 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A textile treatment agent comprising a) polymers with carboxyl groups in a concentration of 1 to 10 wt. %, wherein the polymers comprise monomer units;

b) divalent cations in a concentration of 0.001 to 1.0 wt. %, wherein at least 20% of the monomer units of the polymers carry carboxyl groups, the polymers are polysaccharides and at least 20% of the monomer units of the polysaccharide are uronic acids.

2. The textile treatment agent according to claim 1, wherein the polysaccharide is selected from the group consisting of alginate, pectin, glucosaminoglucans, in particular hyaluronic acid or heparin, astragalus, gum arabicum and teichuronic acids.

3. The textile treatment agent according to claim 1, wherein the divalent cations are selected from Ca(II), Mg(II), Fe(II) and Zn(II) and are added in the form of an inorganic or organic salt.

4. The textile treatment agent according to claim 1, wherein it has a pH of 6 to 11.

5. The textile treatment agent according to claim 1, wherein it is a fabric softener.

6. A method for finishing textile fabrics comprising treating the textile fabrics with the textile treatment agent according to claim 1, wherein the textile fabric is treated with the polymers and the divalent cations, in one process step or in sequential process steps, wherein at least 20% of the monomer units of the polymers carry carboxyl groups, the polymers with carboxyl groups are polysaccharides and at least 20% of the monomer units of the polysaccharides are uronic acids.

7. The method according to claim 6, wherein the divalent cations are selected from Ca(II), Mg(II), Fe(II) and Zn(II), and wherein the divalent cations are added in the form of an inorganic or organic salt.

8. The process according to claim 6, wherein the process comprises sequential method steps including a fabric softening rinse step, and wherein at least one of the components selected from polymers with carboxyl groups and divalent cations is employed in the fabric softening rinse step of the textile washing.

* * * * *